US006724304B2

(12) United States Patent
Risi

(10) Patent No.: US 6,724,304 B2
(45) Date of Patent: Apr. 20, 2004

(54) SECURITY ENTRANCE SYSTEM

(75) Inventor: Alan J. Risi, Beechhurst, NY (US)

(73) Assignee: Georal International Ltd., Whitestone, NY (US)

( * ) Notice: Subject to any disclaimer, the term of this patent is extended or adjusted under 35 U.S.C. 154(b) by 0 days.

(21) Appl. No.: 10/229,796

(22) Filed: Aug. 28, 2002

(65) Prior Publication Data

US 2003/0020607 A1 Jan. 30, 2003

Related U.S. Application Data

(63) Continuation-in-part of application No. 09/772,490, filed as application No. PCT/US99/03218 on Feb. 12, 1999, now Pat. No. 6,472,984.

(60) Provisional application No. 60/104,874, filed on Oct. 20, 1998.

(51) Int. Cl.[7] ..... G08B 21/00

(52) U.S. Cl. ..... 340/540; 340/541; 340/545.2; 340/506; 49/31; 49/68; 109/68; 109/71

(58) Field of Search ..... 340/540, 541, 340/545.1, 545.2, 545.9, 506, 666; 49/31, 68; 109/3, 6, 13, 21, 64, 68, 71

(56) References Cited

U.S. PATENT DOCUMENTS

| | | | | |
|---|---|---|---|---|
| 4,060,039 A | * | 11/1977 | Lagarrigue | 109/3 |
| 4,461,221 A | | 7/1984 | Schandle et al. | |
| 4,656,954 A | | 4/1987 | Tonali | |
| 4,796,542 A | | 1/1989 | Lee | |
| 5,542,211 A | | 8/1996 | Colombo | |
| 5,552,766 A | | 9/1996 | Lee et al. | |
| 5,692,029 A | * | 11/1997 | Husseiny et al. | 378/88 |
| 5,692,446 A | | 12/1997 | Becker et al. | |
| 5,694,867 A | * | 12/1997 | Diaz-Lopez | 109/6 |
| 5,992,094 A | * | 11/1999 | Diaz | 49/31 |
| 6,057,761 A | * | 5/2000 | Yuki | 340/568.1 |
| 6,094,472 A | * | 7/2000 | Smith | 378/86 |
| 6,218,943 B1 | * | 4/2001 | Ellenbogen | 340/572.4 |
| 6,298,603 B1 | * | 10/2001 | Diaz | 49/68 |
| 6,342,696 B1 | * | 1/2002 | Chadwick | 250/225 |

FOREIGN PATENT DOCUMENTS

| | | |
|---|---|---|
| FR | 2 694 098 A1 | 1/1994 |
| IT | 01249275 | 5/1991 |
| WO | IB-WO 00/23958 A1 | 4/2000 |

* cited by examiner

*Primary Examiner*—Toan Pham
(74) *Attorney, Agent, or Firm*—Lerner, David, Littenberg, Krumholz & Mentlik, LLP

(57) ABSTRACT

A security entrance system for controlling access from an infeed area (98) to a protected area (100) has a structure (24) defining a chamber disposed between the infeed area, the protected area and a temporary containment area (201), with a first door (38) at the infeed area portion of the chamber, a second door (46) at the protected area portion of the chamber, and a third door (47) at the temporary containment area portion of the chamber. A person entering the protected area must pass through a contraband detector such as a metal detector (90,92) and enter the chamber. If no alarm was provided by the detector, the doors allow exit from the chamber into the protected area. If an alarm was provided by the metal detector, the doors only allow the person to enter the temporary containment area. The chamber is weighed or otherwise examined after at least some cycles of operation to assure that no contraband was concealed within the chamber.

25 Claims, 6 Drawing Sheets

SECURITY ENTRANCE SYSTEM

CROSS-REFERENCE TO RELATED APPLICATIONS

The present application is a continuation-in-part of U.S. application Ser. No. 09/772,490, filed Jan. 30, 2001, now U.S. Pat. No. 6,472,984, which application is a continuation of PCT International Application PCT/US99/03218, filed Feb. 12, 1999, which International Application was published by the International Bureau in English on Apr. 27, 2000, and the disclosure of which is incorporated by reference herein. Said application, Ser. No. 09/772,490, claims benefit of U.S. Provisional Patent Application Serial No. 60/104,874, filed Oct. 20, 1998, the disclosure of which is incorporated by reference herein.

BACKGROUND OF THE INVENTION

The present invention relates to the field of security entrance systems and more particularly relates to a security entrance system for restricting access from one area to another area.

Many security systems depend on perimeter protection against contraband. For example, in a typical airport security system, devices such as electromagnetic metal detectors are used to prevent smuggling of weapons from an unprotected area, also referred to as the "infeed" area" into the protected area of the airport terminal. Metal detectors and other devices adapted to detect weapons can be deployed in a similar manner to protect other protected areas as, for example, military installations, utility control centers, police stations and other installations susceptible to terrorism. A similar perimeter protection approach can be applied using devices to detect other types of contraband. For example, drug detection devices rather than metal detectors can be applied at customs entry ports. In this instance, the infeed area may constitute the region accessible to incoming travelers prior to customs inspection, whereas the protected area may constitute the free or unrestricted, post-customs region.

Protection using only a detection device such as a metal detector requires constant monitoring of the boundary between the infeed area and the protected area. If the monitoring personnel relax their vigilance even a moment, a smuggler can enter or pass contraband through the opening protected by the detector. For this reason, automatic doors can be used in combination with contraband detectors such as metal detectors. For example, a metal detector may be connected to an automatic door at the entry to the protected area, so that the metal detector detects any metal carried by the person before the person reaches the door and opens the door only if no metal is detected. If the metal detector has detected metal, the door does not open and the person must pass back into the in-feed area through the metal detector. Such a system can be defeated by a smuggler who simply leaves contraband such as a gun behind at the door, just past the metal detector, in a region, which is not examined by the metal detector system. The smuggler steps back out of the system through the metal detector. He then surrenders some innocent metal object such as keys to the security officers monitoring the system to provide an innocent explanation for the initial metal detection and re-enters the protected area through the metal detector, which does not detect any metal. As the door opens, the smuggler retrieves the contraband and enters the protected area.

Some security systems restrict access to a protected area to a designated set of individuals. For example, an entrance to an industrial plant may be provided with doors which require a physical token such as a unique pass card or entry of a unique code to open the door. Other systems use biometric measurements such as hand measurements, pupillary pattern recognition or other biometric parameters to identify a particular authorized user. For example, an employee may insert his or her hand into the machine and physical measurements of the hand may be checked against a database of hand measurements for authorized users. Such arrangements may be combined with a contraband detection system as discussed above. To obtain entry, the employee presents his or her pass card, enters his or her code or provides a biometric measurement. If the system recognizes the pass card, code or biometric measurement, it allows the employee to open the door and also records the identity of the employee and the time of entry. Such systems theoretically can exclude unauthorized persons and can also keep track of the entries and exits of authorized persons. However, these systems can be defeated if more than one person enters the protected area when the door is open. For example, if a first authorized person enters the proper code, the door will operate in response to the code. Two or more people may enter the protected area when the door operates. If an authorized person is careless, or if an authorized person is acting under duress, he or she may let an unauthorized person enter the protected area.

The present invention relates to an early invention U.S. application Ser. No. 09/772,490, filed Jan. 30, 2001. That system provides that a person would enter the system from an unsecured area, undergo detection for contraband, and if suspected of having contraband, exit from the original entrance point. However, that would allow a person caught with contraband to possibly escape back into the unprotected area without being properly detained and/or search. Thus a possible dangerous person would remain at large. The present invention requires an individual suspected of carrying contraband to move into a temporary containment area.

Accordingly, despite all of the effort that has been devoted to contraband detection and security entrance systems in the art heretofore, there are still considerable needs for improvement in security systems and methods.

SUMMARY OF THE INVENTION

The present invention addresses these needs.

One aspect of the present invention provides a security system for restricting access from an infeed area to a protected area and diverting suspicious persons to a temporary containment area. A security system in accordance with this aspect of the invention desirably includes a structure defining an enclosed chamber with a first opening connecting the interior of the chamber with the infeed area, a second opening connecting the interior of the chamber with the protected area, and a third opening connecting the interior of the chamber with the temporary containment area. The structure defining the chamber includes one or more first doors movable between a closed position in which the first door or doors block the first opening and an open position in which the first door or doors do not block the first opening. The structure defining the chamber also includes one or more second doors movable between a closed position in which the second door or doors block the second opening and an open position in which the second door or doors do not block the second opening. The structure defining the chamber also includes one or more third doors movable between a closed position in which the third door or doors block the third opening and an open position in which the third door or doors do not block the third opening.

This system desirably further includes a detector arranged to detect contraband entering the chamber through the first opening as, for example, a electromagnetic or other known metal detector for detecting weapons, a chemical detector such as an ion scan system or other chemically sensitive system for detecting chemical contraband such as drugs or explosives.

The system further includes a chamber monitoring system that is connected to the structure. The chamber monitoring system is arranged to detect at least one characteristic of the structure defining the chamber. Preferably, the chamber monitoring system is arranged to detect the weight of the structure.

The entrance system according to this aspect of the invention desirably also includes a controller connected to the doors, the detection system and the chamber monitoring system. The controller desirably is arranged to operate cyclically. In one normal operating mode, each cycle of the controller includes an entry phase in which the first doors or doors are open to allow a person entry to the chamber, and the detection system is actuated to monitor the entrance to the chamber for contraband. In a further phase of the cycle, the first door or doors are closed and the second door or doors are allowed to open only if no contraband was detected in the entry phase and only while the first and third doors are closed. Thus, the system will not allow a person into the protected area through the second opening unless the first and third doors are closed and no contraband was detected. If no contraband was detected, the cycle ends when the person passes through the second opening, whereupon the second door or doors close. If contraband was detected, the third door or doors are opened and the cycle ends when the person passes out of the chamber through the third opening and into the temporary containment area, whereupon the person can be manually checked for contraband in a controlled environment.

At the end of each cycle, or at least at the end of each cycle in which contraband passing into the chamber was detected by the metal detector or other contraband detector, the controller checks the structure characteristic such as the weight of the structure and chamber when no person is present in the chamber. The controller is arranged to inhibit operation of at least one of the doors during the next cycle if the characteristic of the structure determined by the monitoring system differs from a normal value of such characteristic. For example, if the weight of the chamber-defining structure with no person in the chamber is heavier than its normal empty weight, after the end of a cycle in which the metal detector issued an alarm, the controller may inhibit opening of any of the first, second, or third doors. Stated another way, after contraband has been detected in the chamber when a person leaves, the system shuts down and blocks access to the protected area until the condition is cleared manually by security personnel.

Thus, the system will inhibit passage of a person through the system into the protected area if a preceding person leaves an object in the chamber. Likewise, if a smuggler leaves a gun or other contraband within the chamber he will now be detained within the temporary containment area, thereby preventing the smuggler from entering either the protected area or the infeed area. The security personnel monitoring the system can reset the system to resume normal operation after inspecting the chamber.

Desirably, the structure is arranged to enclose the interior of the chamber so that a person who is disposed within the chamber with all three doors closed cannot reach any part of the system that is not a part of the structure monitored by the chamber monitoring system. Stated another way, the system is arranged so that when the doors are closed, every surface that the person inside the chamber can touch is part of the structure, which is weighed or otherwise measured by the monitoring system. Therefore, it is impossible for a person to conceal contraband within the chamber.

However, after a cycle has started, the controller is arranged to permit open the third door or doors if opening of the second door or doors is inhibited. Therefore, if a person is denied access to the protected area by inhibition of the second door or doors opening, as if contraband is detected, the person can pass into the temporary containment area from the chamber through the third opening. The person will not be trapped within the chamber.

Typically, the security entrance system is arranged to emit an alarm signal if contraband is detected or if the chamber monitoring system detects a change in the characteristics of the chamber as, for example, a change in the weight of the chamber. Typically, the chamber monitoring system includes a base and one or more force transducers connected between the chamber and the base for providing signals related to the weight of the chamber, doors and associated structures. The system optionally may include an activation system for testing a person seeking entry and providing an authorization signal to the controller if such test is passed, thereby establishing that the person is an authorized user. The controller can be arranged to inhibit operation of at least one of the doors if no authorization signal is received from the activation system. For example, the activation system may include a keypad for manual entry of codes and a code comparator for comparing the entered codes to valid codes; a token detector for detecting a badge or other token issued to authorized users; or biometric measurement devices for measuring a biometric characteristic of a person seeking entry.

The same weighing system used to weigh the structure defining the chamber-defining structure when no person is present may also be used to weigh the structure during a cycle while a person is present in the chamber. The controller may be arranged to inhibit operation of the second door unless the detected weight is within preset parameters. For example, the system may be arranged to inhibit operation of the second door if the total weight of the chamber and associated structures with a person in the chamber is above a predetermined maximum threshold, thus indicating that two or more persons are present in the chamber. A fixed maximum threshold may be applied for all authorized users as, for example, about 100 kg over the normal, empty weight of the chamber and associated structures. This provides protection against entry of an unauthorized person along with an authorized person.

Alternatively or additionally, the system may be arranged to inhibit operation of the second door if the weight of the chamber and structures is below a preset person-present threshold as, for example, 6 ounces to 10 Kg above the empty weight of the structure, indicating that no one is present in the chamber.

Where the activation system detects the identity of the user as, for example, by entry of individualized user codes or the use of individualized tokens or biometrics, the system may be arranged to allow opening of the second door only if the total weight of the system is within a relatively narrow range of weights corresponding to the weight with the particular identified individual plus the normal empty weight of the chamber. Weighing systems of this nature assure that the second door will not be opened if the authorized user is accompanied by another person or if a different person has somehow obtained the authorized user's code or token.

The structure can be arranged so that one or more structures defining a chamber can be connected to one or more temporary containment areas. The system can also include one or more package x-ray machines and one or more structures defining a wall partition preventing passage from the infeed area to the protected area, without passage through the chamber. Further, the structure defining the temporary containment area may further include one or more temporary containment area openings connecting the interior of the temporary containment area with one or both of the infeed area and the protected area. The temporary containment area may include temporary containment area doors movable between a closed position in which the temporary containment area doors block the temporary containment openings and an open position in which the temporary containment area doors do not block the temporary containment openings. The temporary containment doors may also include locks holding the temporary containment doors in the closed position. The locks can be opened using the above discussed activation systems.

The foregoing embodiments of the system provide significant safeguards against entry of unauthorized persons along with authorized persons. Moreover, the weight threshold testing features can be provided using the same weighing system, which is used to weigh the chamber and structures while no person is present. Stated another way, the additional security afforded by weight checking while a person is present, and the additional security provided by weighing the empty chamber and associated structures can be accomplished using the same structural elements.

Still further aspects of the present invention provide methods of restricting access to a protected area. Methods according to this aspect of the invention desirably include the steps of providing a chamber having one or more first doors, one or more second doors, and one or more third doors, opening the first door or doors to allow a person entry into the chamber from a infeed area and sensing for contraband as the person enters the chamber. Methods according to this aspect of the invention further include the step of closing the first door and opening the second door if no contraband was sensed as the person entered the chamber so as to allow the person in the chamber access to the protected area. The method includes the step of maintaining the second door closed if contraband was sensed, and opening the third door to allow access into the temporary containment area. Most preferably, the method according to this aspect of the invention includes the additional step of detecting the presence of objects remaining in the chamber after a person has vacated the chamber, and inhibiting further opening of at least one of the doors if an object is detected in the chamber. As discussed above with reference to the apparatus, methods according to this aspect of the invention can use a weighing system or other system for measuring the weight or other physical characteristics defining the chamber. Also as discussed above with reference to the apparatus, the methods desirably include weighing the chamber while a person is present therein and comparing the detected weight to a threshold or range. Such threshold or range that may be a generic for all persons or may be a specific threshold or range for a specific authorized user of the system.

These and other objects, features and advantages of the present invention will be more readily apparent from the detailed descriptions set forth below, taken in conjunction with the accompanying drawings.

DETAILED DESCRIPTION OF THE PREFERRED EMBODIMENTS

Figure 1:
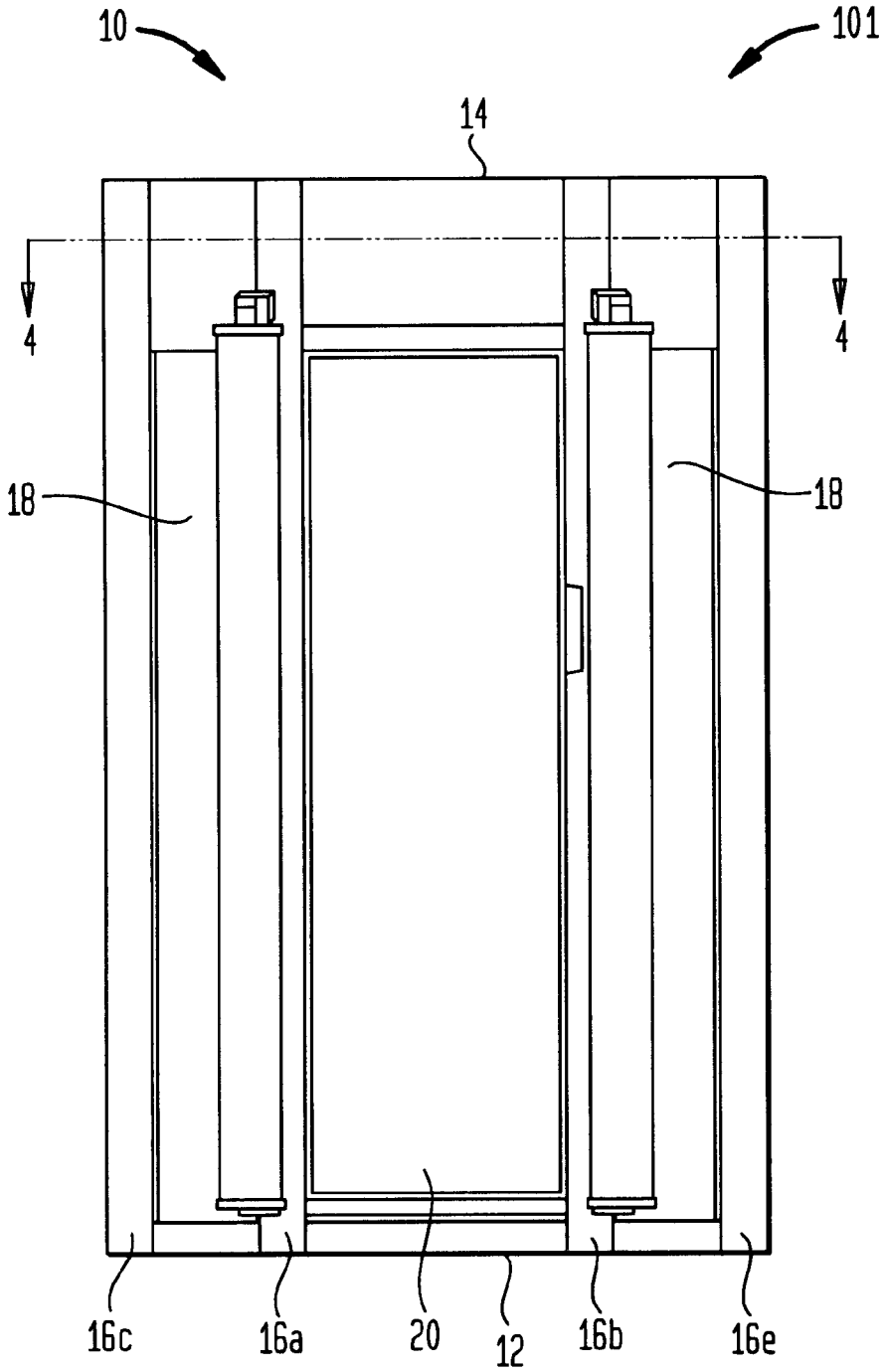
FIG. 1 is a diagrammatic front elevational view depicting a security entrance system in accordance with one embodiment of the invention.
Figure 2:
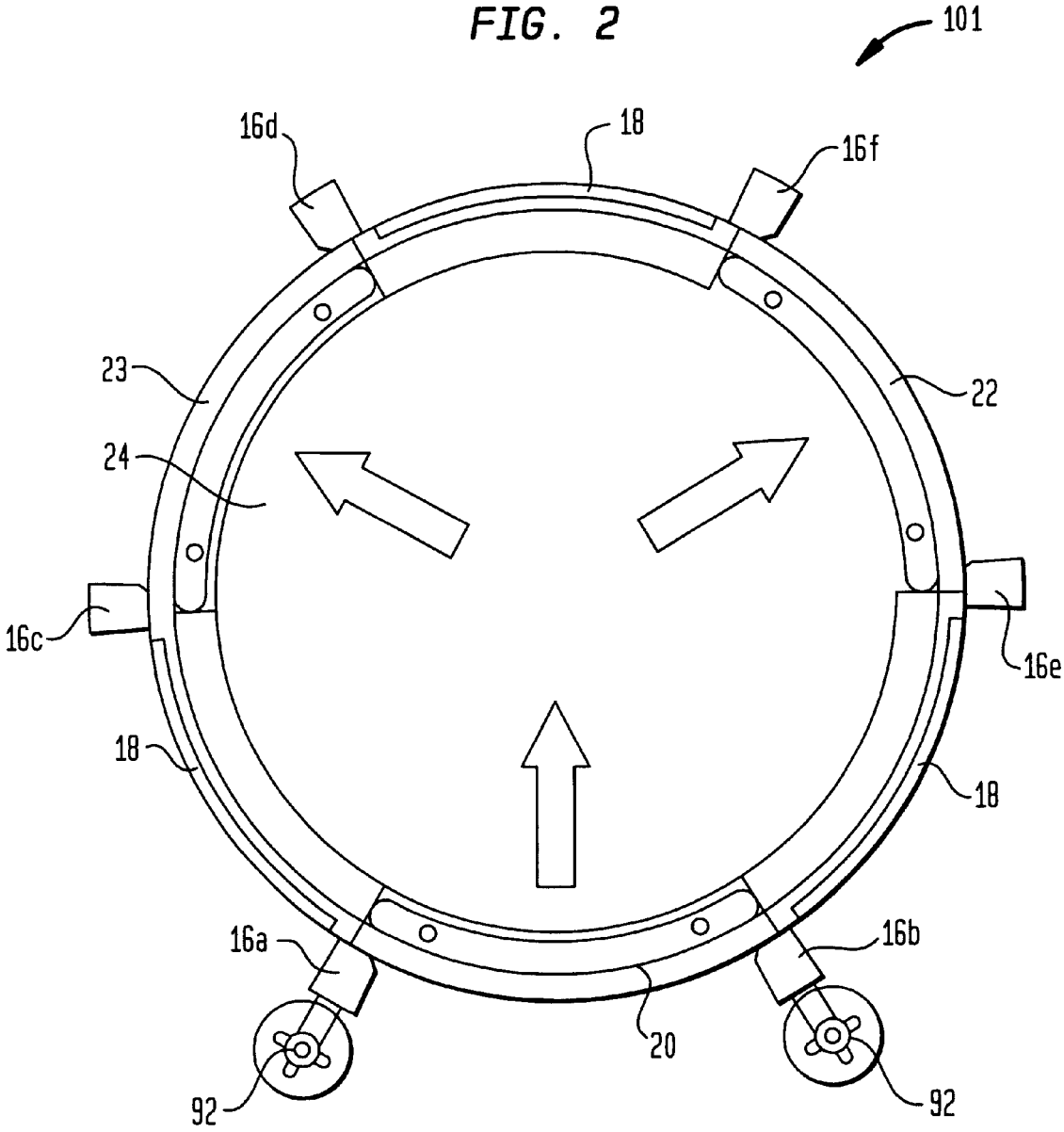
FIG. 2 is a diagrammatic top view of the system shown in FIG. 1.

As shown in FIG. 1, a security system 101 in accordance with one embodiment of the invention includes an external housing 10 having a bottom portion 12, top portion 14, and six pillars 16 extending between the top and bottom portions and forming side walls of the outer frame. There is a first portal 20 at a first or infeed area portion of the frame, between pillars 16*a* and 16*b* (FIG. 1), a second portal 22 (FIG. 2) at a second or protected area portion of the frame, between pillars 16*c* and 16*d*, and a third portal 23 at a third or temporary containment area portion of the frame, between pillars 16*e* and 16*f*. Side walls 18 extend between the pillars but do not block the portals. The side walls of the external structure desirably are formed from a transparent but strong material such as bullet resistant glass.

Figure 3:
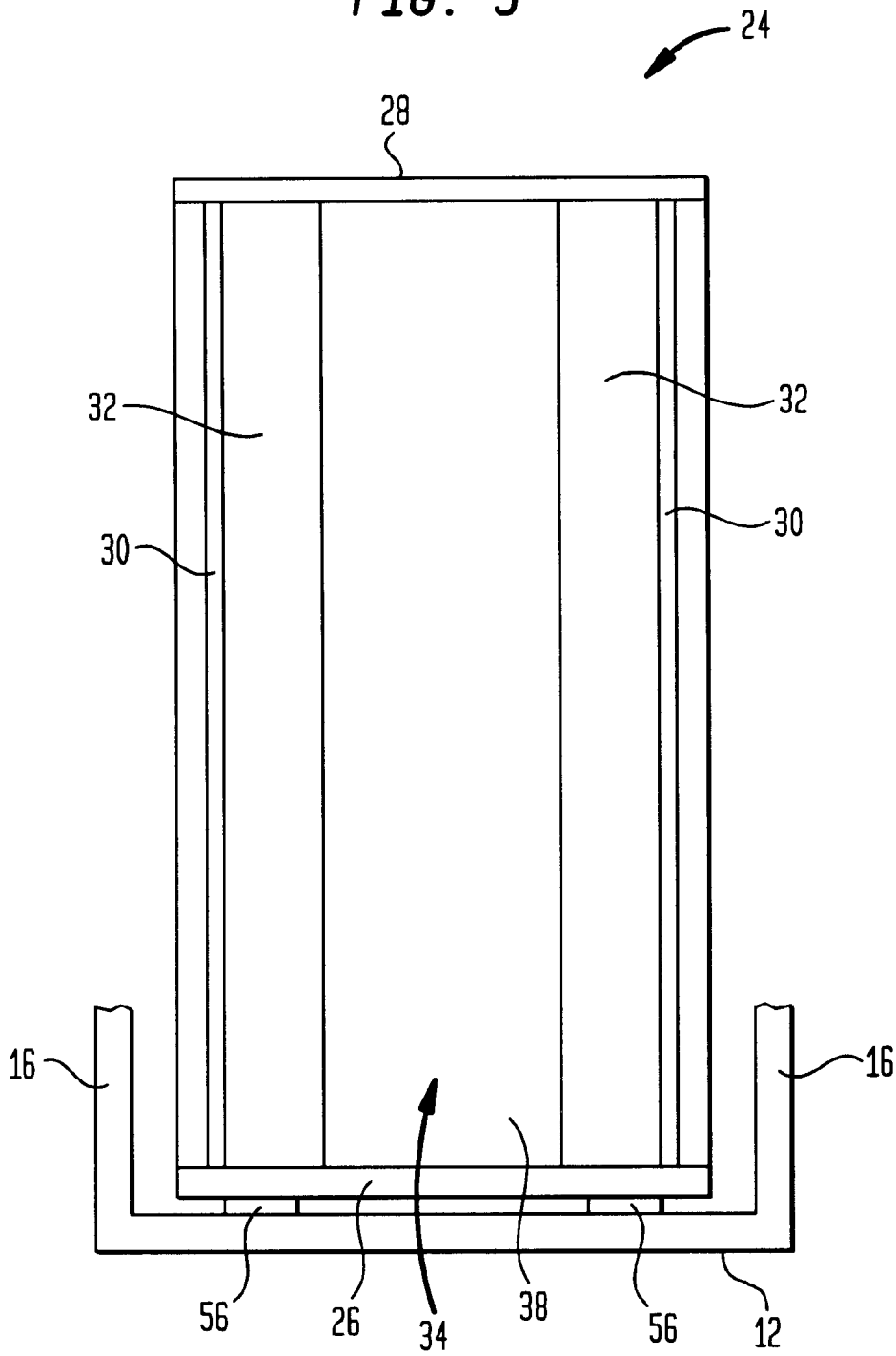
FIG. 3 is a diagrammatic front elevational view of the system shown in FIGS. 1–2, with certain components removed for clarity of illustration.
Figure 4:
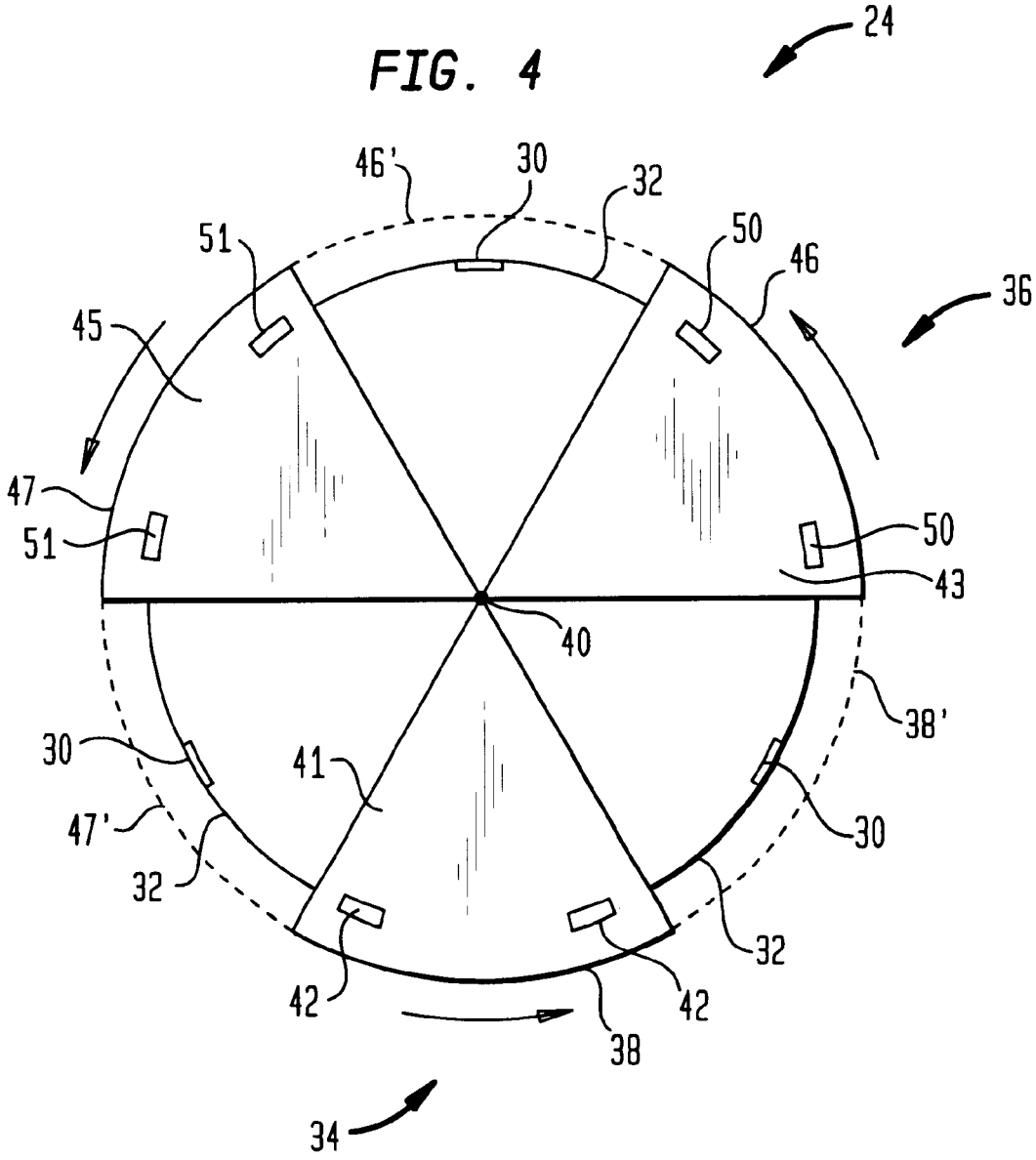
FIG. 4 is a diagrammatic top view of the internal components used in the system of FIGS. 1–3.

As shown in FIGS. 3 and 4, the system further includes an internal structure 24 having a floor element 26, a ceiling element 28, and three vertical frame members 30 extending between the floor and ceiling elements. Three inner side walls 32 formed from a transparent material such as glass or transparent polymer are mounted to the vertical frame elements 30 and extended between the floor element 26 and ceiling element 28. The internal structure 24 defines a first opening 34 at the infeed area portion, a second opening 36 at the protected area portion, and a third opening 37 at the temporary containment area portion.

The internal structure also includes a first door 38. The first door is mounted on a sector element 41 disposed above ceiling element 28 and supported on the ceiling element by a pair of rollers 42. The sector element 41 and first door 38 are mounted for pivoting movement about a door pivot axis 40 so that the door can move from the full closed position depicted in solid lines in FIG. 4 to the full open position 38' depicted in broken lines in FIG. 4. The lower edge of the door 38 is also guided by a track in floor element 26 or other suitable guide elements (not shown). When the first door 38 is in the full closed position, it blocks the first opening 34 of inner structure 24.

The inner structure also includes a second door 46 that is supported on sector element 43 and rollers 50 and also guided at its lower end. The door is arranged for pivoting movement around the door pivot axis 40, so that the second door can move from the full closed position 46 and the full open position 46' (FIG. 4). When the second door is in the full closed position 46, it blocks the second opening 36 of the internal structure.

The inner structure also includes a third door 47 that is supported on sector element 45 and rollers 51 and also guided at its lower end. The door is arranged for pivoting movement around the door pivot axis, so that the third door can move from the full closed position 47 and the full open position 47' (FIG. 4). When the third door is in the full closed position 47, it blocks the third opening 37 of the internal structure. Further, when the first, second, and third doors are in their fully closed positions, the internal structure defines an enclosed chamber bounded by the internal side walls 32 and by the doors 38, 46, and 47.

The internal structure 24 is mounted inside external frame 10, so that the first opening 34 of the internal structure is aligned with the first portal 20 of the external frame, the second opening 36 of the internal structure is aligned with the second portal 22 of the external frame, and the third opening 37 of the internal structure is aligned with the third portal 23 of the external frame. The doors 38, 46, and 47 are disposed between the external side wall 18 and the internal side wall 32 when the doors are in their respective open positions. The internal structure 24 is supported within the external frame 10 by a set of load cells 56 physically disposed between the floor element 26 and the lower frame element 12. The load cells are conventional weight-sensing elements arranged to detect the weight of the internal structure 24 and anything disposed inside the chamber defined by the internal structure, and to provide an electrical signal representing the weight. For example, the load cells may be of the strain-gauge type incorporating a resilient member such as a spring and a conventional strain-gauge arranged to detect the deformation of the spring. Other conventional types of load-sensing elements such as capacitive, magnetostrictive, hydraulic, and optical load-sensing elements may be used. Desirably, the load cells are arranged to provide a weighing range from an empty weight equal to the weight of the internal structure alone to a maximum weight equal to the weight of the internal structure plus a maximum load threshold, desirably about 300 Kg or more. The load cells are also arranged to provide sensitivity of about 170 g, at least in the lower end of the weighing range, close to the empty weight.

Figure 5:
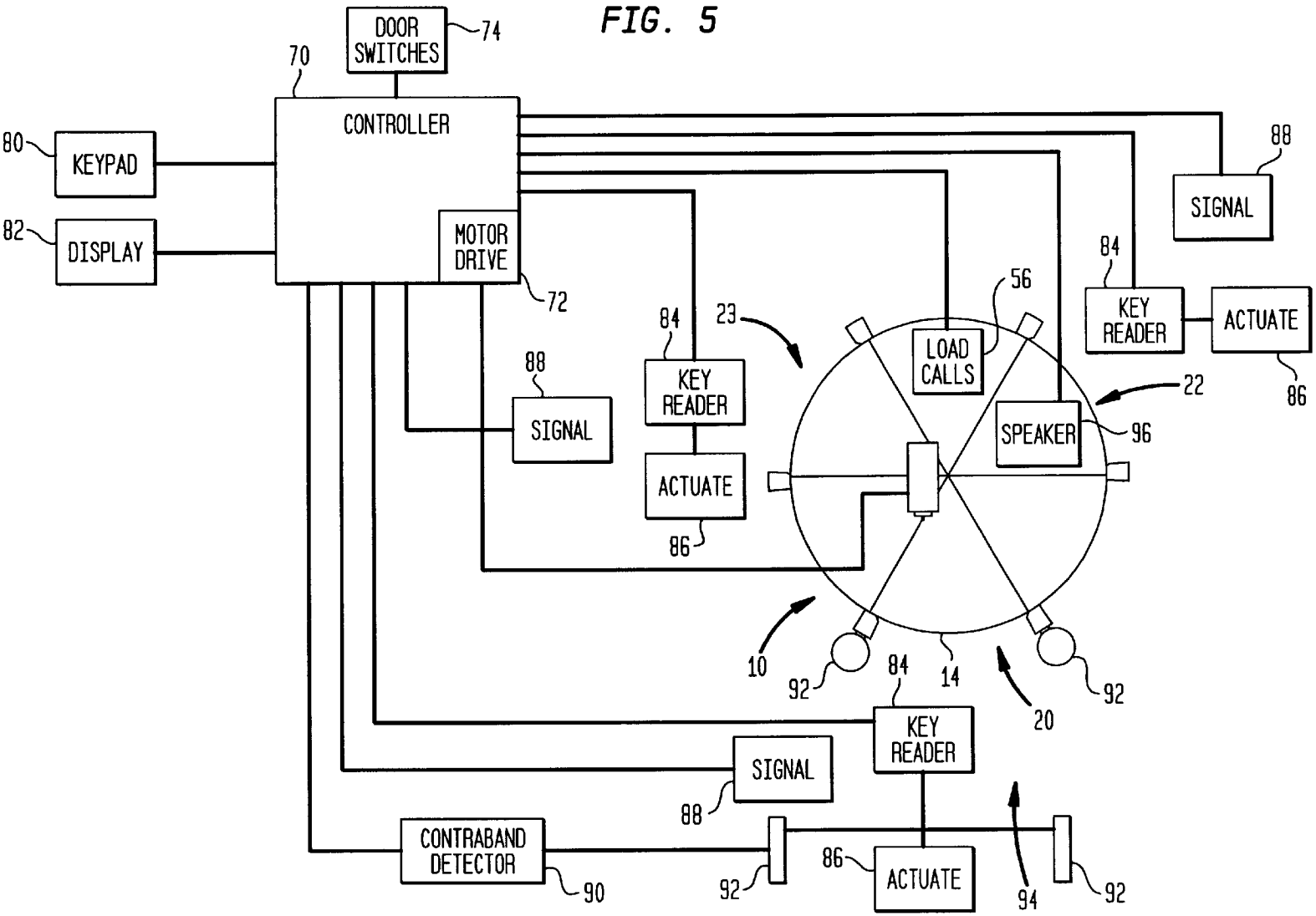
FIG. 5 is a functional block diagram of the system shown in FIG. 1; and, FIG. 6 is a top plan view depicting another embodiment of the invention.

A motor drive unit 72 (FIG. 5) is mounted within the top portion 14 of the external housing 10. The motor drive unit 72 is connected through linkage to each of the three doors. The motor drive unit 72 incorporates at least one motor, desirably a stepper motor and power transmission elements such as a gear train, chain drive, belt drive or the like, preferably, the motor drive unit includes separate motors associated with each door 38, 41 and 47. Alternatively, the motor drive unit can include a single motor and clutches for selectively connecting the motor to any one of the doors.

The system also includes a controller 70 incorporating a solid state microcontroller such as a Texas Instruments TMS370C756 microcontroller with associated storage elements such as an electronically erasable programmable read-only memory ("EEPROM") (not shown). The controller also includes an appropriate analog circuit for detecting signals from load cells 56 and an internal analog to digital converter. The electrical circuit connected to the load cells desirably also includes field adjustable elements such as potentiometers for nulling the load cells to provide a predetermined signal at the empty weight. The controller also includes the motor drive unit 72 for opening each of the doors and for detecting the positions of the doors as they move from full open to full closed position.

Switches 74 connected to the controller are provided for detecting when each door is at its full open position or full closed position. A keypad 80 and display screen 82 are also linked to the controller 70. Controller 70 is connected to a battery (not shown) and to a mains power supply such as an ordinary power plug for connection to conventional utility power. The controller includes a mains power failure sensor, which detects absence of normal power at the utility plug, and a low battery sensor, which detects the drop in the voltage from the battery.

The system further includes key readers 84 at the first portal 20, the second portal 22, and the third portal 23. The key readers are arranged to read individual keys used by security personnel operating the system. The key readers may be mechanically actuated key switches for conventional devices for reading electrically encoded keys. Desirably, the key readers, together with the controller, are arranged to read keys in any of four classifications, denominated as manager, cleaner, guard or emergency keys. Where electrically or magnetically encoded keys are employed, the controller may be arranged to memorize individual codes on particular keys as belonging to any of the various classes during a key acquisition or learning phase of operation.

The system further includes an actuator 86 and a signal light set 88 at each portal. The signal light set is arranged to provide a visible signal indicating to the user when he should proceed into the system as, for example, a green light for proceed and a red light for stop. In the embodiment illustrated, the actuator is simply a push button, which can be actuated by any person passing through the system. As further explained below, however, more complex actuators, such as biometric or numeric keypad devices may be employed.

The system also includes a contraband detector 90 arranged to detect contraband at the infeed area portion of the system. The contraband detector may be a conventional electromagnetic or other metal detector having a set of sensing elements 92 disposed adjacent to a space 94 just outside of first portal 20 and first opening 34. The metal detector is arranged to provide an alarm signal to controller 70 if metal is detected passing through the detector space 94. One suitable type of metal detector is commercially available under the designation 2PN8HI from the CAA, S.p.A. of Viciomaggio (AZ), Italy.

The system further includes a voice synthesizer (not shown) integrated in controller 70. The voice synthesizer is linked to a speaker 96 disposed within the chamber. An intercom (not shown) may also be provided for allowing communication between a person within the chamber and security personnel outside of the chamber.

Figure 6:
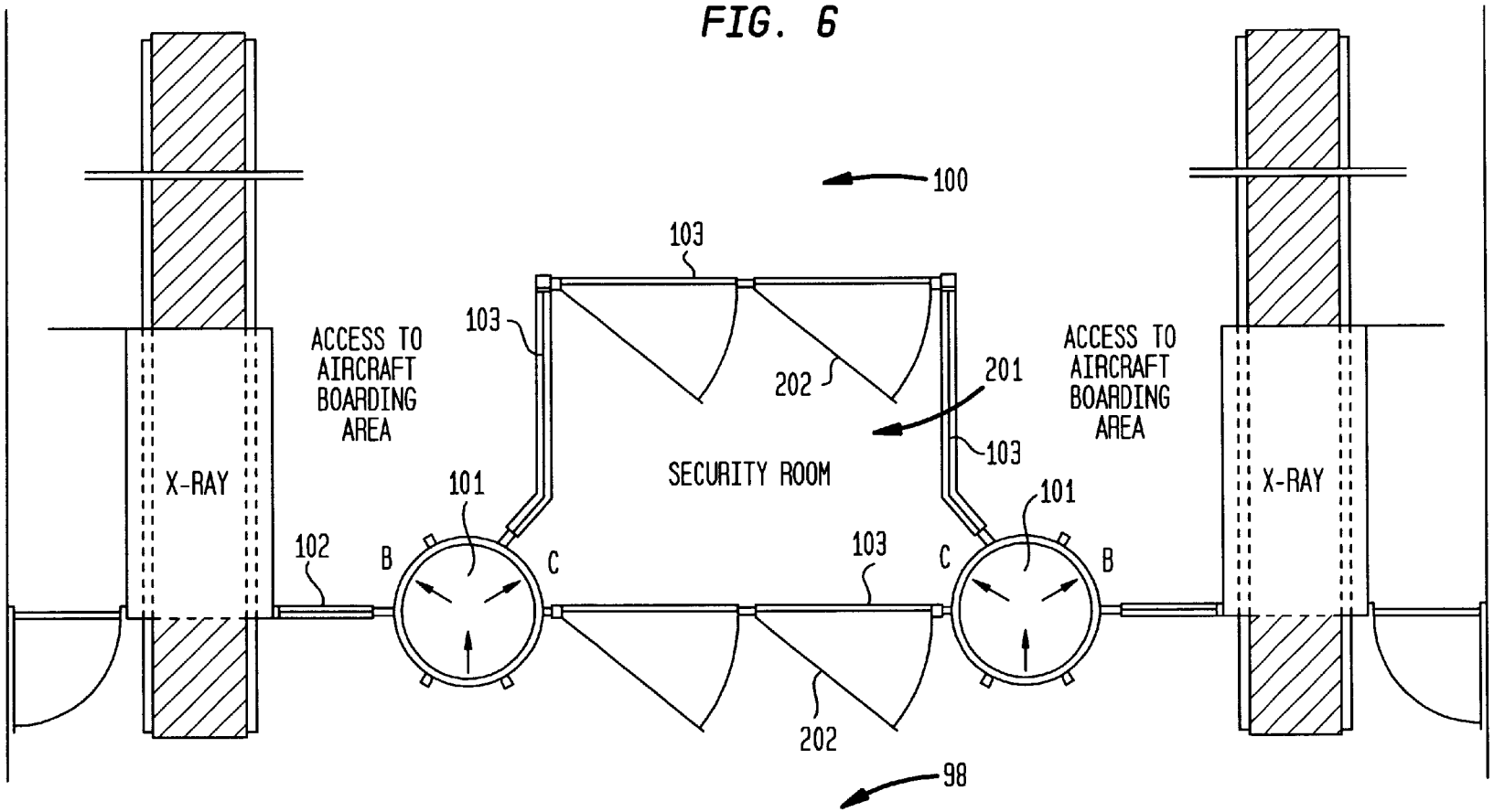

As shown in FIG. 6, the system typically is installed at an entry point connecting an infeed or unprotected area 98 and a protected area 100. Two chambers 101 each having features as discussed above with reference to FIGS. 1–5, are used as parts of the overall system shown in FIG. 6. The infeed area 98 and the protected area 100 are separated from one another by a walls 102 or other type of barrier, so that a person seeking to enter the protected area from the infeed area must pass through one of the chambers 101. Walls 103 form temporary containment area 201. This area is an enclosed area in which a personal search of a suspicious individual can occur, while still detaining said individual. Each chamber 101 communicates with the temporary containment area 201 at the third opening 23 of such chamber in order to allow for individuals, upon detection of contraband, to move into the temporary containment area 201 for detainment until a further search can occur. The temporary containment area 201 may also include doors 202. These doors may allow for further functions to be performed. For example, the temporary containment area 201 may include one or more doors 202 to allow security personnel access to those persons suspected of having contraband. These doors would provide one or more access points for security personnel needed to perform individual searches. In another example, the temporary containment area 201 may contain a door from the infeed area 98 and a door to the protected area 100. Security personnel passing quickly through the system, handicapped individuals in wheelchairs, larger vehicles or equipment, and the like may use such doors. The controller 70 associated with each chamber 101 can be arranged so that a signal can be entered through the actuator switch 86 to open the temporary containment area doors 202. Alternatively, these doors can be provided with independent key-operated opening mechanisms.

In one normal operating mode, referred to herein as a multidirectional transit mode, the system waits with first door 38 in its full open position and with second door 46 and third door 47 in their full closed position. A cycle of operations starts when a person seeking entry to the protected area passes through the metal detection space 94 and into the chamber through the first opening 34. The person's weight is carried by the floor element of the internal structure and transmitted to load cells 56. When load cells 56 determine that the weight of the internal structure and the contents of the chamber is above a preset person-in-chamber threshold (typically set at 170 kg or more above the empty weight of the internal structure alone), the controller recognizes that a person has entered the chamber and checks to see if an alarm signal was sent by the metal detector. Provided that no alarm signal was sent by the metal detector, and provided that the weight of the internal structure and chamber contents together, as detected by load cells, is below a preset maximum limit, the controller 70 actuates the motor drive unit 72 to close the first door 38. When the first door 38 has reached its full closed position, the controller 70 actuates the second door 46 to open, thereby allowing the person access to the protected area 100. After a preset time, typically about 5 seconds, sufficient for a person to exit from the chamber, the controller actuates the second door 46 to close once again.

The controller then rechecks the weight of the internal structure and chamber once again. If the weight of the internal structure and chamber is above the person-in-chamber threshold, indicating that a person still remains within the chamber, the controller actuates the second door once again, allowing the person a second opportunity to exit from the chamber. Before opening the second door, the controller may issue a voice command through the loud speaker instructing the person to proceed through the second door and into the protected area. If the weight of the internal structure and chamber is below the preset person in chamber threshold, indicating that the person has exited from the chamber, the controller actuates the second door drive motor 66 to close second door 46. When the second door has reached its full closed position, the controller actuates the first door drive motor 62 to open the first door, thus readying the system for a new cycle.

If the weight exceeds the maximum limit, the controller does not open second door 46, but instead issues a command through speaker 96 directing the person or persons within the chamber to exit the chamber through the first door, and holds the first door open. Typically, the weight of the chamber will exceed the maximum threshold if more than one person is in the chamber in a single cycle.

If metal detector 90 issued an alarm signal, then the controller actuates the motor drive unit 72 to close the first door 38. When the first door 38 has reached its full closed position, the controller actuates the third door 47 to open and issues a voice command through speaker 96 directing the person to step into the temporary containment area 201. While in this temporary containment area, the person can be personally checked by security personnel using hand held detection wands or the like. When the weight of the chamber and internal structure drops below the person present threshold, indication that the person has stepped out of the chamber and into the temporary containment area 201, the controller closes the third door 47. When the third door 47 reaches its full closed position, as indicated by door switches 74, the system waits for a preselected dwell time, sufficient to allow transient effects caused by movement of the person or movement of the doors to dissipate. At this time, the system checks the weight of the chamber and internal structure. If the weight of the chamber and internal structure is above a preset concealed object threshold, the controller stops further automatic operation and leaves all of the doors closed. The controller also issues a perceptible signal such as a message on the display screen indication an object in chamber alarm. Typically, the concealed object threshold is set to about 170 grams above the empty weight of the chamber and internal structure.

When the controller is in this alarm condition, it can only be reset to resume further automatic operation by manual input from the keypad. Typically, this condition will occur if a person who triggered the metal detector seeks to defeat the system by leaving a gun or other contraband inside the chamber for someone to carry into the protected area in a subsequent cycle.

If the weight of the chamber is below the object in chamber threshold, the controller will clear the alarm signal set by the metal detector and begin a new cycle, whereupon a new person can be checked for contraband. Upon being manually checked for contraband, the original suspicious individual can be admitted directly to the protected area 100, if security personnel believe he is clean. However, if the manual search turns up contraband, the person can be detained.

If a person wishes to pass in the reverse direction, from the protected area 100 or the temporary containment area 201 to the infeed area 98, he or she can enter a signal through actuator switch 86 at the either the second portal 22 or the third portal 23. In response to this signal, the controller closes first door 38 and then opens the corresponding second door 46 or third door 47. When the weight of the chamber and internal structure exceeds the person in chamber threshold, the controller closes the corresponding second door 46 or third door 47 and opens the first door 38. After the person leaves the chamber, and the weight of the chamber falls below the person in chamber threshold, the controller actuates the first doors to close and again checks the weight of the chamber and internal structure.

If the weight of the chamber is above the weight of the object in chamber threshold, the controller again issues the object in chamber alarm and ceases automatic operation until manually reset by security personnel using the keyboard.

In a variant of the operating procedures discussed above, the system normally waits with the first, second, and third doors closed. The first door opens only when commanded to do so by an input through actuator 86 at the infeed area 98 of the system. In a further variant, the system is set to allow transit through the chamber only from the infeed area 98 to protected area 100 or the containment area 201. Thus, the system disregards input from the actuator 86 at the protected area of the system. In a further variant, the system closes all three doors and executes a residual weight check after each person has exited from the chamber, regardless of whether the metal detector did or did not issue an alarm condition.

The controller senses abnormal conditions. For example, if a door is blocked by an object in its path during closing motion, a door edge detector will issue a signal to the controller, and the controller will reverse the closing motion. The controller is arranged to try the closing motion once again and, if unsuccessful, to reopen the door which it was attempting to close and leave that door in the full open condition. Also, if the door switches 74 do not indicate that a door has reached the full closed or full open position within a preset time after movement was commanded, the controller recognizes that the door is jammed and stops the automatic movement of the door. In the event of a mains power failure, the controller disables unnecessary elements such as the signal lights and any internal lighting within the chamber, but continues normal operation. If the controller detects low battery voltage, it disables automatic operation.

The controller also provides for abnormal modes of operation. In an emergency mode, invoked by depressing an emergency key on keypad 80, the controller commands all of the doors to open. Also, commands entered from the keypad can override the object in chamber, excessive weight or metal detector alarms and allow the second door to open during normal, automatic operation. Special modes of operation are also provided for cleaning, startup and shut down. These are controlled by appropriate combinations of keys inserted in key readers and signals entered through the keypads associated with the controller.

In the embodiment discussed above, only a single system 101 with a single chamber is connected to each controller. Preferably, however, the controller is arranged so that a plurality of chambers and their associated doors, metal detectors, and weight sensors are controlled by one controller. This plurality of chambers in turn can be positioned to utilize one or more temporary containment units. Furthermore, the controllers in turn may be connected to a master computer in a network arrangement. The controllers desirably area arranged to log all unusual events such as metal detection alarms, object in chamber alarms, and the like. The log desirably includes the particular condition and the time at which such condition occurred.

The simple push button actuators 86 provided at the openings of the system may be replaced by more complex actuators such as numeric keypads which require entry of particular codes known only to authorized users or biometric testing devices which measure the body of the user and issue an authorization signal only if the user's physical characteristics match the physical characteristics of an authorized user. The controller is arranged to prevent actuation of one or all of the doors unless it receives an appropriate actuation signal from such an actuator. This restricts entry to the protected area to only authorized personnel.

In a further variant, the system may be provided with contraband detectors other than metal detectors as, for example, chemically sensitive detectors for detecting explosives or narcotics. Also, contraband detectors may be provided at all openings of the system. Further, contraband detection can be configured to take place once an individual has entered the chamber. In this variant, all of the doors may be closed prior to contraband detection, thereby detaining the individual before checking him for contraband.

The particular arrangement of doors and door movement devices discussed above is merely exemplary. Numerous other arrangements can be employed. For example, each door may include a set of doors that slide in opposite directions from one another. Also, the doors may be conventional hinged doors. Many types of actuators other than the stepper motor drives discussed above can be used to drive doors between open and closed positions. For example, other electric motor drives, solenoid power units, pneumatic or hydraulic systems may be employed. In a further variant, the door movement may be performed manually. The controller may be arranged to wait for a door set to be opened or closed, as signaled by door switches, and may be arranged to impede manual opening or closing of one door set until another door set is closed and all other conditions for opening the doors are satisfied. For example, in the normal operating mode discussed above, the controller would be arranged to wait until a person had entered the chamber and had closed the first door before allowing the opening of the second or third door. The controller would also latch the any of the doors closed if the metal detector had issued an alarm signal.

The system may be provided with additional features such as a wider door to accommodate persons in wheelchairs. For example, in the United States such access is required in some installations for compliance with the Americans with Disabilities Act ("ADA"). Also, the size and shape of the chamber can be varied as desired. For example, instead of the circular shape illustrated in FIG. 2, the chamber may be generally oblong in shape.

As discussed above, pneumatic cushions may be provided on the edges of the doors. These cushions, along with light beam detectors, provide a safety feature in that they detect the presence of a person or other object in the doors and prevent crushing injuries caused by the closing doors. The cushions can be constructed to prevent a person from inserting a blade or other weapon into the chamber through the cushions.

The present invention can be used in the security industry, for protection of buildings and other facilities and areas.

As these and other variations and combination of the features discussed above can be utilized without departing from the present invention, the foregoing description of the preferred embodiments should be taken by way of illustration rather than by way of limitation of the invention as defined by the claims.

What is claimed is:

1. A security entrance system for restricting access from an infeed area to a protected area and diverting suspicious persons to a temporary containment area comprising:

a) a structure defining an enclosed chamber with a first opening connecting the interior of said chamber with said infeed area, a second opening connecting the interior of said chamber with said protected area, and a third opening connecting the interior of said chamber with said temporary containment area, said structure including one or more first doors movable between a closed position in which said first doors block said first opening and an open position in which said first doors do not block said first opening, one or more second doors movable between a closed position in which said second doors block said second opening and an open position in which said second doors do not block said second opening, and one or more third doors movable between a closed position in which said third doors block said third opening and an open position in which said third doors do not block said third opening;

b) a contraband detection system operative to detect contraband entering said chamber;

c) a chamber monitoring system connected to said structure for measuring at least one characteristic of said structure defining said chamber; and d) a controller connected to said doors, said detection system and said chamber monitoring system, said controller operating cyclically, each cycle including allowing said first door to open to allow a person entry to said chamber, actuating said detection system to scan said chamber for contraband entering the chamber and allowing said second door to open if no contraband is detected and said first door and said third door are closed, thereby allowing the person entry to the protected area, or allowing said third door to open if contraband is detected and said first door and said second door are closed, thereby allowing the person entry to said temporary containment area, said controller inhibiting operation of at least one of said doors if at least one characteristic of said structure as determined by said chamber monitoring system while no person is present in said chamber differs from a normal value of such characteristic, whereby said controller will inhibit passage of a person into said protected area if any object is left in said chamber during a preceding cycle.

2. The security entrance system as claimed in claim 1 wherein said at least one characteristic of said structure includes the weight of the structure.

3. The security entrance system as claimed in claim 2 wherein said controller is operative to prevent opening of said third door in one cycle if the weight of said structure detected after completion of a previous cycle differs from the normal weight of said structure.

4. The security entrance system as claimed in claim 3 wherein said controller is operative to permit opening of said third door during any portion of the cycle of operation, and wherein said controller is operative to inhibit opening of said second door while said first door or said third door is open, whereby if a person is denied access to said protected area by inhibition of second door opening, such person can pass into said temporary containment area from said chamber through said third opening.

5. The security entrance system as claimed in claim 3 wherein said controller includes means for emitting an alarm signal if contraband is detected by said detection system or if the weight of said structure after one cycle differs from said normal weight.

6. The security entrance system as claimed in claim 3 further comprising an outer frame, wherein said chamber monitoring system comprises one or more force transducers operatively connected between said internal structure and said outer frame for detecting the weight of said chamber.

7. The security entrance system as claimed in claim 2 wherein said chamber further includes a sensor at said first door, a sensor at said second door, and a sensor at said third door, said sensors detect obstructions at the doors to prevent the doors from closing on a person or object.

8. The security entrance system as claimed in claim 2 wherein said security entrance system further includes an activation system for testing a person seeking entry and providing an authorization signal to said controller if such test is passed, said controller inhibiting operation of at least one of said doors if such test is not passed.

9. The security entrance system as claimed in claim 8 wherein said activation system includes a keypad for manual entry of a code by a person seeking entry and a code comparator for comparing such code to valid codes.

10. The security entrance system as claimed in claim 8 wherein said activation system includes a badge detector for detecting a badge having a predetermined configuration.

11. The security entrance system as claimed in claim 8 wherein said activation system includes a biometric measurement device for measuring a biometric characteristic of a person seeking entry.

12. The security entrance system as claimed in claim 2 wherein said contraband detection system includes a metal detection system.

13. The security entrance system as claimed in claim 1 wherein said structure encloses the interior of said chamber so that a person within said chamber cannot reach any part of the system which is not monitored by said chamber monitoring system when said doors are closed.

14. The security entrance system as claimed in claim 13 wherein when said first, second, and third doors are in said closed positions, said structure entirely encloses said chamber apart from ventilation openings.

15. The security entrance system as claimed in claim 1 wherein a structure defines said temporary containment area wherein said temporary containment area prevents a person within said temporary containment area from reaching any area outside of said temporary containment area.

16. The security entrance system as claimed in claim 15 wherein said temporary containment area further comprises one or more temporary containment area openings connecting the interior of said temporary containment area with one or both of said infeed area and said protected area, said temporary containment area openings including one or more temporary containment area doors movable between a closed position in which said doors block said temporary containment area openings and an open position in which said doors do not block said temporary containment area openings.

17. The security entrance system as claimed in claim 16 further comprising locks holding said temporary containment area doors in said closed position.

18. The security entrance system as claimed in claim 17 further comprising an activation system for testing a person seeking entry and providing an authorization signal to said locks if such test is passed, said locks inhibiting operation of at least one of said temporary containment area doors if such test is not passed.

19. The security entrance system as claimed in claim 18 wherein said activation system includes a keypad for manual entry of a code by a person seeking entry and a code comparator for comparing such code to valid codes.

20. The security entrance system as claimed in claim 18 wherein said activation system includes a badge detector for detecting a badge having a predetermined configuration.

21. The security entrance system as claimed in claim 18 wherein said activation system includes a biometric measurement device for measuring a biometric characteristic of a person seeking entry.

22. A method of restricting access to an area comprising the steps consisting of:

a) providing a chamber having one or more first doors, one or more second doors, and one or more third doors;

b) opening said first doors to allow a person entry to the chamber from an infeed area;

c) sensing for contraband as the person enters the chamber;

d) if no contraband was sensed during entry to the chamber, closing the first door and opening said second door to allow the person access to the protected area, but if contraband was sensed maintaining said second door closed, closing said first door, and allowing said third door to open to provide access from the chamber to the temporary containment area; and e) detecting the presence of objects remaining in said chamber after the person has vacated the chamber, and inhibiting opening of at least one of said doors if an object is detected in said chamber.

23. A security entrance system for restricting access from an infeed area to a protected area and diverting suspicious persons to one or more temporary containment areas comprising:

a) one or more structures, each said structure being associated with one of said one or more temporary containment areas, each said structure defining an enclosed chamber with a first opening connecting the interior of such chamber with said infeed area, a second opening connecting the interior of such chamber with said protected area, and a third opening connecting the interior of such chamber with said temporary containment area associated with such chamber, each said structure including one or more first doors movable between a closed position in which said first doors of such structure block said first opening of such structure and an open position in which said first doors of such structure do not block said first opening of such structure, one or more second doors movable between a closed position in which said second doors of such structure block said second opening of such structure and an open position in which said second doors of such structure do not block said second opening of such structure, and one or more third doors movable between a closed position in which said third doors of such structure block said third opening of such structure and an open position in which said third doors of such structure do not block said third opening of such structure;

b) one or more contraband detection systems, each said contraband detection system being associated with one or more said structures, operative to detect contraband entering said structure associated with said contraband detection system;

c) one or more chamber monitoring systems connected to one or more of said structures, defining each said chamber, for measuring at least one characteristic of said structure associated with said chamber monitoring system; and d) one or more controllers connected to each said doors of each said chamber, each said detection system and each said chamber monitoring system, said controllers of such chamber, detection system and chamber monitoring system, operating cyclically each cycle including allowing said first door of such structure to open to allow a person entry to said chamber, actuating said detection system of such structure to scan said chamber for contraband entering said chamber and allowing said second door of such structure to open if no contraband is detected and said first door of such structure and said third door of such structure are closed, thereby allowing the person entry to said protected area, or allowing said third door of such structure to open if contraband is detected and said first door of such structure and said second door of such structure are closed, thereby allowing the person entry to said temporary containment area associated with such structure, said controller of such structure inhibiting operation of at least one of said doors of such structure if at least one characteristic of said structure as determined by said chamber monitoring system of such structure, while no person is present in said chamber, differs from a normal value of such characteristic, whereby said controller of such structure will inhibit passage of a person into said protected area associated with such structure if any object is left in said chamber during a preceding cycle.

24. The security entrance system of claim 23 further comprising two said chambers both of said chambers associated with one said temporary containment area.

25. The security entrance system of claim 23 further comprising:

a) one or more package x-ray machines; and b) one or more partitions preventing passage, absent through said openings of such chambers, from said infeed area to said protected area.

* * * * *